US012286744B2

(12) United States Patent
Conjard et al.

(10) Patent No.: US 12,286,744 B2
(45) Date of Patent: Apr. 29, 2025

(54) DOMESTIC APPLIANCE FOR IRONING AND/OR STEAMING COMPRISING AT LEAST TWO VAPORIZATION CHAMBERS CONNECTED TO EACH OTHER BY A CONNECTING DUCT

(71) Applicant: SEB S.A., Ecully (FR)

(72) Inventors: Florian Conjard, Ecully (FR); Jean-Claude Guery, Ecully (FR); Franck Da Palma, La Talaudiere (FR)

(73) Assignee: SEB S.A. (FR)

( * ) Notice: Subject to any disclaimer, the term of this patent is extended or adjusted under 35 U.S.C. 154(b) by 10 days.

(21) Appl. No.: 18/214,295

(22) Filed: Jun. 26, 2023

(65) Prior Publication Data

US 2023/0416974 A1 Dec. 28, 2023

(30) Foreign Application Priority Data

Jun. 27, 2022 (FR) ..... 2206387

(51) Int. Cl.
*D06F 75/38* (2006.01)
*D06F 75/24* (2006.01)

(52) U.S. Cl.
CPC ..... *D06F 75/38* (2013.01); *D06F 75/24* (2013.01)

(58) Field of Classification Search
CPC ..... D06F 75/00–38
See application file for complete search history.

(56) References Cited

U.S. PATENT DOCUMENTS 2,263,532 A * 11/1941 Sussman ..... D06F 75/12 38/77.6
2,573,174 A * 10/1951 Bate ..... D06F 75/12 38/90
3,852,899 A * 12/1974 Mackey ..... D06F 75/12 38/77.83
5,979,089 A 11/1999 Bouleau et al.
(Continued)

FOREIGN PATENT DOCUMENTS

CN 208328504 U 1/2019
EP 1702098 A1 9/2006
(Continued)

OTHER PUBLICATIONS

French Preliminary Search Report for App No. 2206387, dated Feb. 14, 2023, 2 pages. [See p. 1, categorizing the cited references].
(Continued)

*Primary Examiner* — Ismael Izaguirre
(74) *Attorney, Agent, or Firm* — Lerner David LLP

(57) ABSTRACT

A domestic appliance for ironing and/or steaming includes at least a first vaporization chamber and a second vaporization chamber arranged in a heating body containing at least one electric resistance, and a distribution circuit enabling a flow of steam to be conveyed from the second vaporization chamber to at least one steam outlet hole, the first vaporization chamber and the second vaporization chamber being positioned in series and connected to each other by at least one connecting duct, wherein the connecting duct is formed by a connecting tube inserted in the heating body, the connecting tube running in an area of the heating body heated by said at least one electrical resistance.

16 Claims, 5 Drawing Sheets

(56) References Cited

U.S. PATENT DOCUMENTS

| | | | | |
|---|---|---|---|---|
| 6,953,912 | B2 * | 10/2005 | Alday Lesaga | D06F 75/38 38/77.83 |
| 7,673,404 | B2 * | 3/2010 | Guohong | D06F 75/24 38/77.83 |
| 10,309,053 | B2 * | 6/2019 | Yagi | D06F 75/18 |

FOREIGN PATENT DOCUMENTS

| | | | | |
|---|---|---|---|---|
| EP | 2009173 | A2 | 12/2008 | |
| EP | 2138628 | A1 * | 12/2009 | D06F 75/10 |
| FR | 2523164 | A * | 9/1983 | D06F 75/12 |
| FR | 2849453 | A1 | 7/2004 | |

OTHER PUBLICATIONS

European Search Report for App No. 23173460, dated Aug. 24, 2023, 2 pages. [See p. 1, categorizing the cited references].

* cited by examiner

[Fig. 1]
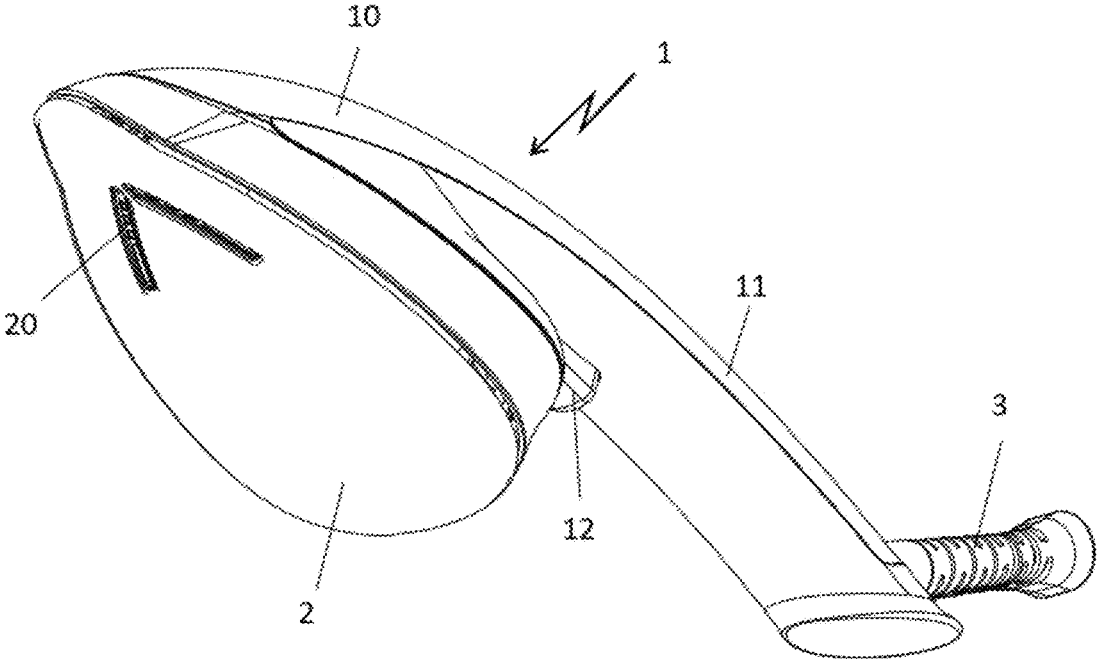
[Fig. 2]
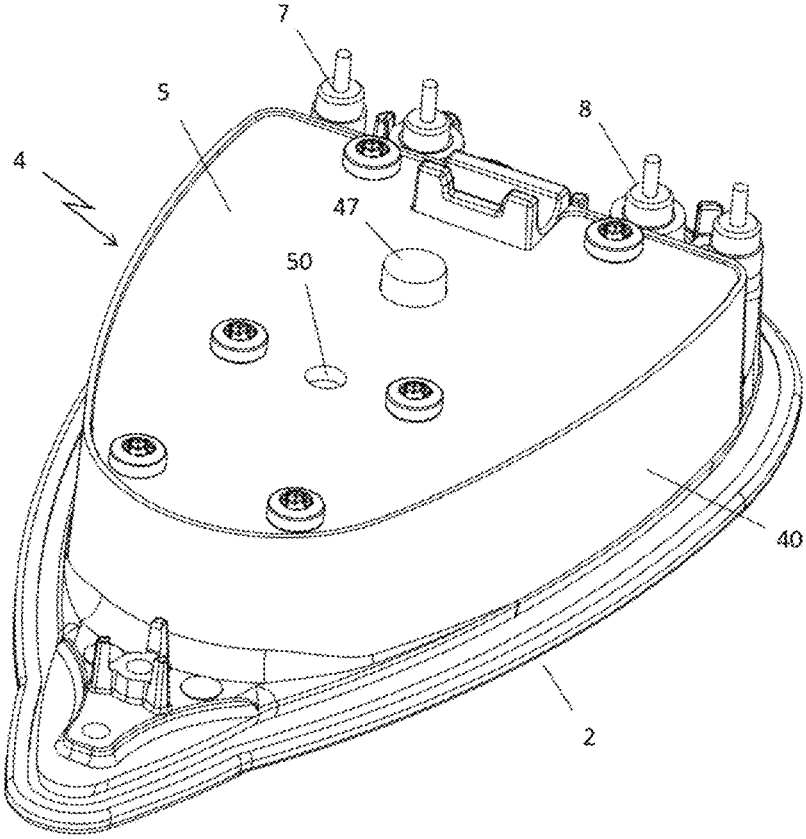

[Fig. 3]
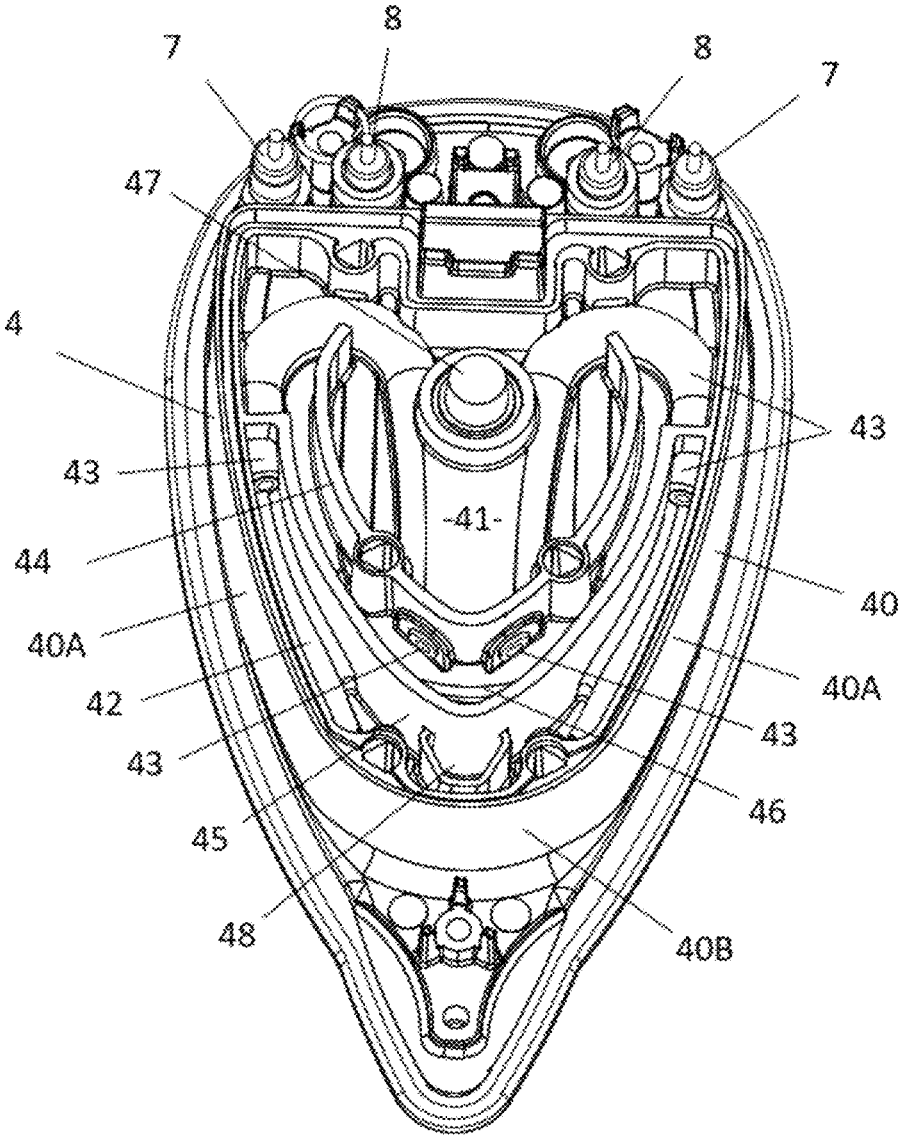

[Fig. 4]
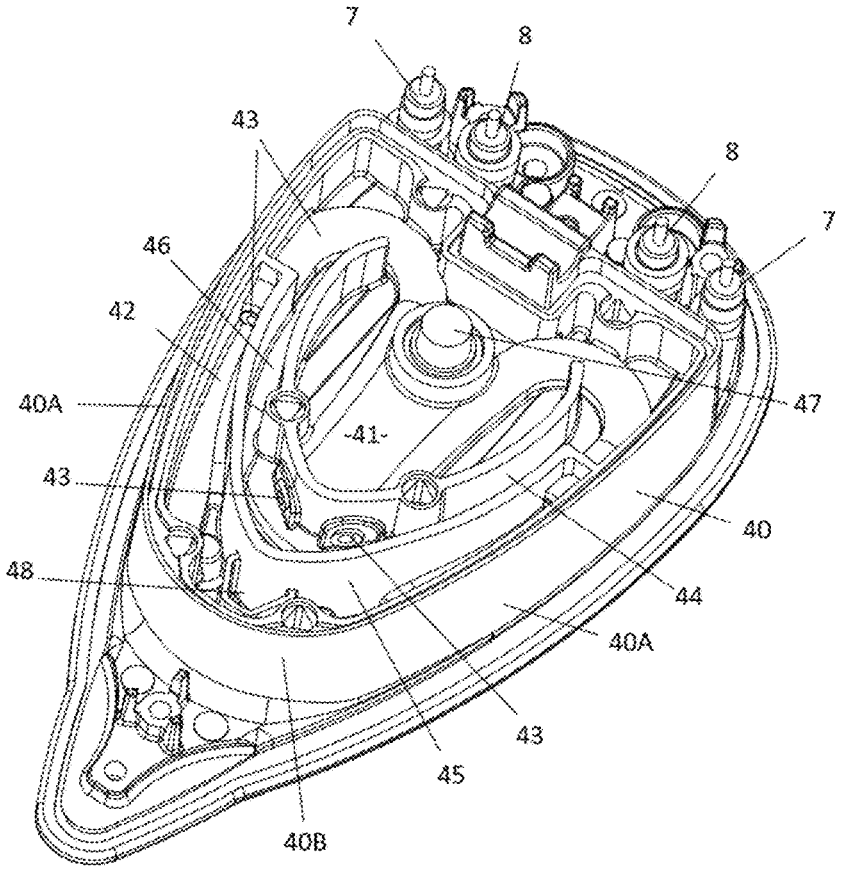
[Fig. 5]
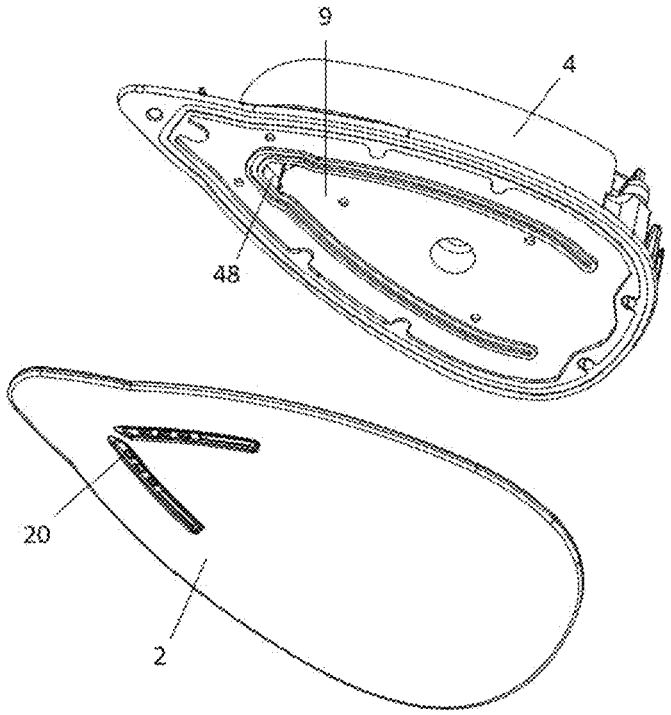

[Fig. 6]
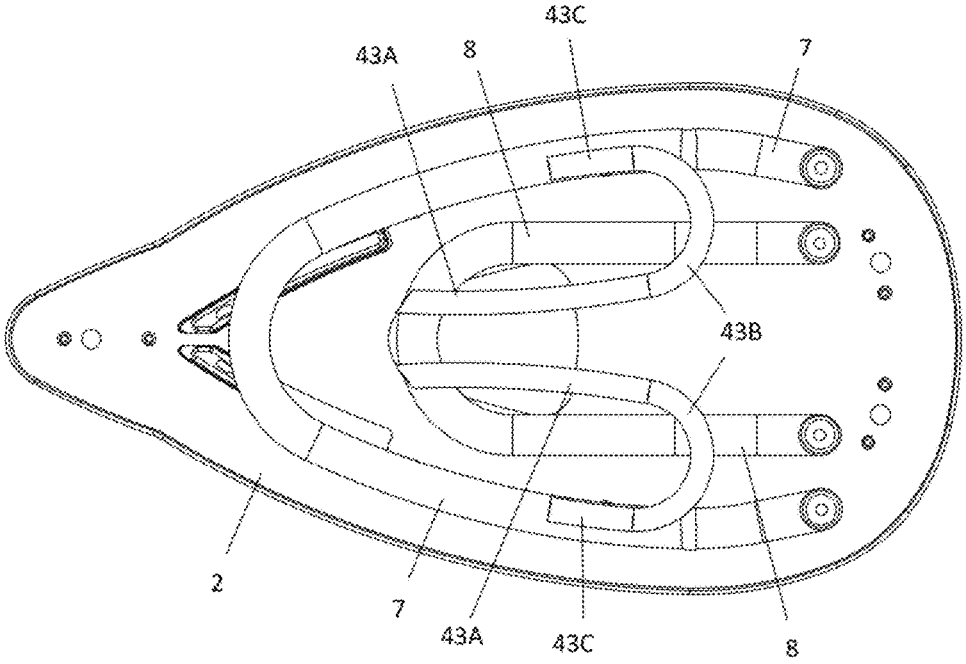
[Fig. 7]
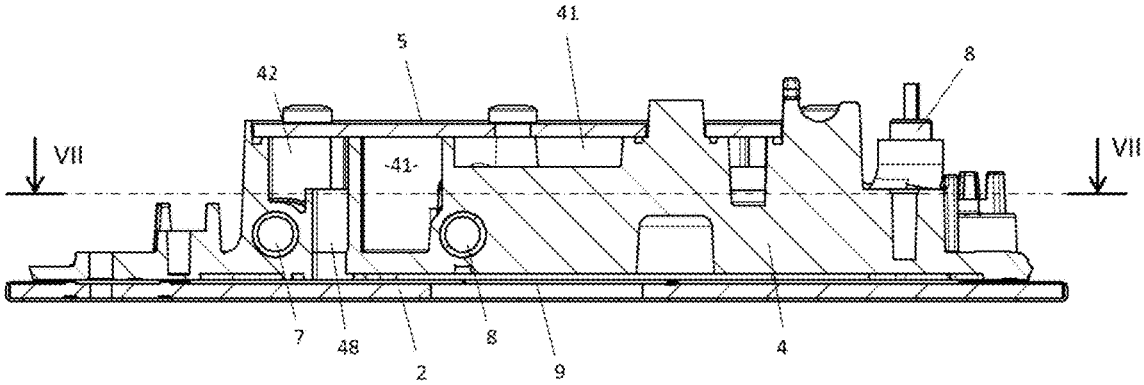

[Fig. 8]
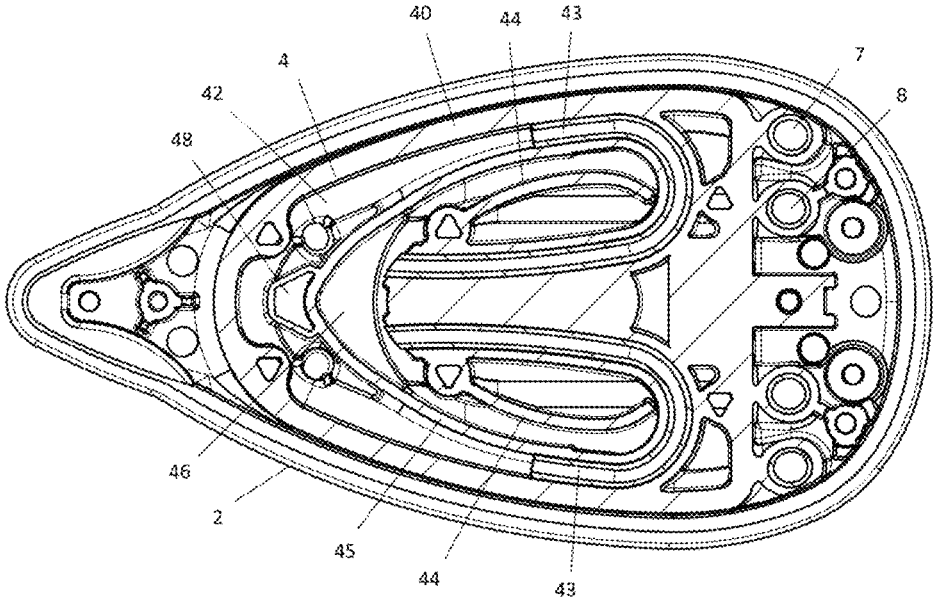
[Fig. 9]
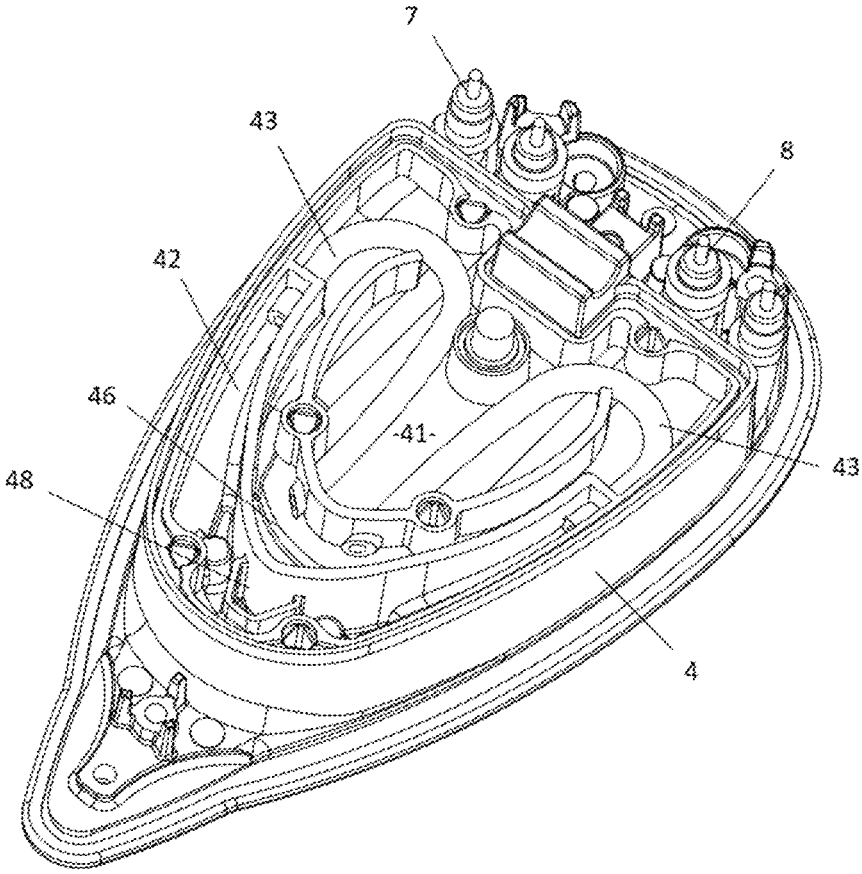

DOMESTIC APPLIANCE FOR IRONING AND/OR STEAMING COMPRISING AT LEAST TWO VAPORIZATION CHAMBERS CONNECTED TO EACH OTHER BY A CONNECTING DUCT

CROSS-REFERENCE TO RELATED APPLICATIONS

This application claims priority from French application number 2206387, filed Jun. 27, 2022, the disclosure of which is hereby incorporated herein by reference.

TECHNICAL FIELD

The present invention relates to the field of domestic appliances for ironing and/or steaming comprising a vaporization device comprising at least a first vaporization chamber and a second vaporization chamber arranged in a heating body containing at least one electric resistance, and a distribution circuit designed to convey a flow of steam from the second vaporization chamber to at least one steam outlet hole. The invention relates more particularly to an appliance in which the first vaporization chamber and the second vaporization chamber are positioned in series and connected to each other by at least one connecting duct.

STATE OF THE ART

Patent application EP1314811 discloses an iron comprising a first vaporization chamber and a second vaporization chamber arranged in a heating body containing two electric resistances, the first and second vaporization chambers being positioned in series and connected to each other by a connecting duct.

Such a construction of the heating body makes it possible to limit the risk of water droplets being projected from the steam outlet holes when the iron is used in a horizontal position. However, it does not prevent water droplets from being projected when the iron is used in a substantially vertical position and is tilted to the side or held upside down, for example when steaming a curtain or a garment hanging on a hanger.

SUMMARY OF THE INVENTION

The present invention aims to remedy this drawback by providing a vaporization device with optimized evaporation capacity. In particular, the invention aims to provide a vaporization device that ensures optimal vaporization, regardless of the orientation of the vaporization device, so as to reduce and, if possible, eliminate the risk of non-vaporized water droplets being projected from the steam outlet holes of the appliance when the latter is used in multiple orientations. The present invention also aims to provide a vaporization device with optimized evaporation capacity and compact construction.

To this end, the invention aims to provide a domestic appliance for ironing and/or steaming comprising a vaporization device comprising at least a first vaporization chamber and a second vaporization chamber arranged in a heating body containing at least one electric resistance, and a distribution circuit enabling a flow of steam to be conveyed from the second vaporization chamber to at least one steam outlet hole, the first vaporization chamber and the second vaporization chamber being positioned in series and connected to each other by at least one connecting duct, characterized in that the connecting duct is formed by a connecting tube inserted in the heating body, the connecting tube running in an area of the heating body heated by said at least one electrical resistance.

The use of such a connecting tube in the heating body makes it possible, by a means that is simple and economical to implement, to lengthen the steam circuit by running it through a superheated area of the heating body. This considerably increases the vaporization capacity of the vaporization device, as the steam is forced to circulate through the superheated connecting tube before being diffused into the second vaporization chamber.

The device may also have one or more of the following features, taken alone or in combination.

According to an advantageous feature of the invention, the connecting tube runs near said at least one electrical resistance.

According to an advantageous feature of the invention, the connecting tube runs in an area of the heating body where the temperature is greater than 150° C.

According to another advantageous feature of the invention, the first vaporization chamber is supplied with water from a water tank.

According to another advantageous feature of the invention, the supply of water to the first vaporization chamber takes place through an injection port in a lid closing the first vaporization chamber.

According to another advantageous feature of the invention, the first vaporization chamber is supplied exclusively with a liquid water flow and not with a steam flow.

According to another advantageous feature of the invention, the second vaporization chamber is supplied with a mixture of steam and of water droplets.

According to an advantageous feature of the invention, the connecting tube is made of stainless steel.

Such a feature limits the adhesion of scale to the inside of the connecting tube, which keeps the connecting tube from clogging quickly over time.

According to an advantageous feature of the invention, the connecting tube has a bent portion.

Such a feature keeps any water droplets from running through the connecting tube without coming into contact with the tube walls. This increases the evaporation capacity of the water droplets in the connecting tube irrespective of the orientation of the heating body.

Such a feature also makes it possible to create a winding path between the first vaporization chamber and the second vaporization chamber and thereby lengthen the path of the steam in the connecting tube.

According to an advantageous feature of the invention, the bent portion is bent at 180°.

Such a 180° bend forces any water droplets carried by the steam to come into contact with the inner wall of the connecting tube to be vaporized.

According to an advantageous feature of the invention, the connecting tube has an inlet port and an outlet port oriented in substantially the same direction.

According to an advantageous feature of the invention, the connecting tube extends near the center of the heating body.

Such a feature makes it possible to have both a compact construction and to route the connecting tube in the area of the heating body that is typically the hottest.

According to an advantageous feature of the invention, the heating body comprises a casting made of aluminum or magnesium.

According to an advantageous feature of the invention, the connecting tube is at least partially embedded in the casting.

Such a feature makes it possible to ensure, by a simple and economic means, that the connecting tube is firmly set in the heating body while optimizing the heat transfer between them.

According to an advantageous feature of the invention, the connecting tube runs on the surface of the first vaporization chamber or of the second vaporization chamber.

According to an advantageous feature of the invention, the second vaporization chamber extends to the perimeter of the first vaporization chamber.

Such an arrangement makes it possible to achieve a compact heating body.

According to an advantageous feature of the invention, the first vaporization chamber and the second vaporization chamber are arranged on an upper face of the heating body and the steam distribution circuit is arranged on a lower face of the heating body, the heating body comprising a through opening putting the second vaporization chamber in communication with the steam distribution circuit.

According to an advantageous feature of the invention, said at least one electrical resistance runs in a bottom wall of the heating body.

According to an advantageous feature of the invention, the heating body comprises a peripheral wall that delimits a space in which the first vaporization chamber and the second vaporization chamber are arranged, said peripheral wall extending from the bottom wall to a lid attached to the heating body.

According to an advantageous feature of the invention, the heating body comprises a partition wall that extends from the bottom wall to the lid and connects two opposite areas of the peripheral wall, the partition wall forming a separation between the first vaporization chamber and the second vaporization chamber.

According to an advantageous feature of the invention, the lid comprises a water and/or steam injection port positioned facing an evaporation surface of the first vaporization chamber.

According to an advantageous feature of the invention, the second vaporization chamber extends in the shape of a "V" around the first vaporization chamber.

According to an advantageous feature of the invention, the through opening is positioned at the top of the "V" of the second vaporization chamber.

According to an advantageous feature of the invention, the heating body comprises an inner wall that delimits, together with the partition wall, a flow channel for the steam flow inside the first vaporization chamber, the tube comprising an inlet port that opens into said flow channel.

According to an advantageous feature of the invention, the first vaporization chamber and the second vaporization chamber are connected to each other by two connecting tubes inserted in the heating body.

The invention also relates to a method for manufacturing an appliance as previously described in which the heating body is made by molding in a mold and in which the connecting duct is positioned in the mold prior to molding the heating body.

According to an advantageous feature of the invention, the heating body is made by casting an aluminum or magnesium casting.

BRIEF DESCRIPTION OF THE FIGURES

The purposes, aspects and advantages of the present invention will be better understood from the following description of two specific embodiments of the invention provided as non-limiting examples, with reference to the appended drawings in which:

FIG. 1 is a perspective view of an iron according to a first particular embodiment of the invention;

FIG. 2 is a perspective view of the heating body and of the soleplate on the iron in FIG. 1;

FIG. 3 is a perspective view of the top of the heating body in FIG. 2 without its closing plate;

FIG. 4 is another perspective view of the heating body in FIG. 3;

FIG. 5 is an exploded perspective view of the heating body and of the soleplate in FIG. 1;

FIG. 6 is a top view illustrating the position of the heating resistances and of the connecting tubes, with the casting of the heating body not shown in this figure;

FIG. 7 is a longitudinal cross-sectional view of the heating body in FIG. 3;

FIG. 8 is a cross-sectional view along line VIII-VIII of FIG. 7;

FIG. 9 is a perspective view of a heating body according to a second embodiment of the invention.

Only those elements required in order to understand the invention have been depicted. In order to facilitate interpretation of the drawings, the same elements are labeled with the same references across all the figures.

It will be noted that, in this document, the terms "horizontal," "vertical," "lower," "upper," "top," "bottom," "front," "rear," "longitudinal" and "transverse" are used to describe the iron refer to this device when it is sitting flat on its soleplate.

FIG. 1 shows an iron 1 comprising a flat soleplate 2 with steam outlet holes 20, the soleplate 2 having a pointed front end and a rounded rear end. The soleplate 2 is topped by a plastic housing 10 comprising a handle 11, the rear end of which is connected by a cord 3 to a base (not illustrated in the figure) containing a reservoir.

As shown in FIGS. 2 to 4, the housing 10 of the iron 1 contains a heating body 4 positioned in thermal contact with the soleplate 2, the heating body 4 comprising a casting, advantageously made of aluminum. The heating body 4 comprises an upper surface where a peripheral wall 40 projects vertically and is closed in its upper part by a lid 5, visible in FIG. 2, that rests on the peripheral wall 40 and is sealingly connected thereto.

Preferentially, the heating body 4 comprises a bottom wall containing a first electrical resistance 7 and a second electrical resistance 8, each comprising two connecting ends opening out near the rear end of the heating body 4, outside the volume defined by the peripheral wall 40.

As shown in FIG. 5, the first electrical resistance 7 is generally V-shaped and comprises branches extending parallel to the soleplate 2, along side parts 40A and a front part 40B of the peripheral wall 40. This first electrical resistance 7 advantageously has a power of about 925 W.

The second electrical resistance 8 is generally U-shaped and smaller than the first electrical resistance 7, the second electrical resistance 8 extending inside the branches of the first electrical resistance 7 and being positioned in the same plane as the latter. The second electrical resistance 8 advantageously has a power of about 545 W.

The bottom wall, the peripheral wall 40 and the lid 5 delimit a space containing a vaporization device comprising a first vaporization chamber 41 and a second vaporization chamber 42 positioned in series and connected to each other by two connecting tubes 43.

The first vaporization chamber 41 is arranged in the central part of the heating body. It is bordered in its rear part by the peripheral wall 40 and is delimited in its front part by a partition wall 45 that extends vertically from the bottom wall to the lid 5 and runs laterally between the two side parts 40A of the peripheral wall 40 along a V-shaped path that substantially follows the shape of the rim of the heating body 4.

The first vaporization chamber 41 is supplied with water from the tank through an injection port 50 arranged in the lid 5, facing an evaporation surface positioned in a central area of the first vaporization chamber 41, located between the branches of the first electrical resistance 7.

This central area is bordered in its front and side parts by an inner wall 44 that projects vertically from the bottom wall and extends to the lid 5, the inner wall 44 extending parallel to the partition wall 45 and delimiting with it a V-shaped steam flow channel 46 that runs substantially above the first electrical resistance 7.

Due to the presence of the inner wall 44, the steam flow can only escape from the central area through a rear opening arranged between the two ends of the inner wall 44, the bottom wall comprising near this rear opening a stud 47 provided to receive a thermostat, not shown in the figures. This thermostat is used to control the power supply to the first 7 and second 8 heating resistances in order to keep the first vaporization chamber 41 around a set temperature, which can be adjusted by the user, of about 150° C.

As shown in FIGS. 3 and 4, the second vaporization chamber 42 is in the shape of a V-shaped cavity that is arranged between the peripheral wall 40 and the partition wall 45 and that extends substantially above the first electrical resistance 7. This second vaporization chamber 42 communicates with a steam distribution circuit 9, arranged on a lower side of the heating body 4, through a through opening 48 arranged at the front end of the second vaporization chamber 42.

The steam distribution circuit is formed by a cavity 9, shown in FIG. 5, advantageously arranged between the heating body 4 and the soleplate 2, this cavity 9 supplying steam to the steam outlet holes 20 of the soleplate 2.

As shown in FIGS. 6 to 8, the first vaporization chamber 41 is connected to the second vaporization chamber 42 by two connecting tubes 43 which are preferentially embedded in the aluminum casting of the heating body 4, the two connecting tubes 43 being advantageously positioned symmetrically relative to the longitudinal axis of the heating body 4.

Each connecting tube 43 has an inlet opening that advantageously opens into the steam flow channel 46 in the inner wall 44 and an outlet opening that opens into the second vaporization chamber 42, preferably at the part of the partition wall 45 delimiting the rear end of the second vaporization chamber 42.

As shown in FIG. 5, each connecting tube 43 runs in the heating body 4 along a J-shaped path, and successively has, starting from the inlet port, a first substantially straight portion 43A extending parallel to one of the branches of the second electrical resistance 8, a bent portion 43B, bent at 180°, extending outwardly above the first 7 and second 8 electrical resistances and a second substantially straight portion 43C extending above the first electrical resistance 7.

The connecting tubes 43 run over a length advantageously greater than 5 cm and are preferentially made of stainless steel, each connecting tube 43 having an internal diameter of about 2 mm and an external diameter of about 4 mm.

In a known manner per se, the injection port 50 is supplied with water by a pump, not shown in the figures, which is incorporated into the base and the operation of which is controlled by a trigger 12 positioned under the front end of the handle 11, the pump advantageously having a flow rate greater than 35 gr/min when the trigger 12 is actuated.

The operation of the iron 1 will now be described.

When the user actuates the trigger, water is injected by the pump through the injection port 50 and is projected into the central area of the first vaporization chamber 41. As the central area is positioned in the immediate vicinity of the second electrical resistance 8, it is permanently kept at a high temperature and ensures a high degree of vaporization of the water injected through the injection port 50 when the iron 1 is positioned horizontally.

When the iron 1 is positioned vertically, the water injected into the first vaporization chamber 41 is sent by gravity either towards the rear part of the peripheral wall 40 when the iron is positioned point upwards, or against the inner wall 45 when the front point of the soleplate 2 is turned to the side or downwards. Thus, only the steam, which may include small water droplets, can escape in the direction of the steam flow channel 46.

As the steam flow channel 46 extends between the first electrical resistance 7 and the second electrical resistance 8, the temperature prevailing therein is very high, which quickly heats the water droplets carried by the steam flow. The water droplets carried by the steam flow are then projected against the V-shaped end of the partition wall 45 where they are vaporized for the most part. Any water droplets passing through the connecting tubes 43 are then largely vaporized in the latter, due to the path of the connecting tubes 43 in areas of the bottom wall that are superheated by the first 7 and second 8 electrical resistances. The steam flow from the connecting tubes 43 then flows into the second vaporization chamber 42, which extends above the first electrical resistance 7, such that any droplets still present in the steam flow are finally vaporized before the steam flow can escape through the through opening 48 in the direction of the steam distribution circuit 9 and the steam outlet holes 20 of the soleplate 2.

The iron 1 thus achieved has the advantage of being particularly compact while allowing for a high steam flow rate and greatly limiting the risk of spewing water droplets, regardless of the orientation of the soleplate 2.

In particular, inserting tubes into the heating body 4 to establish the connection between the first vaporization chamber 41 and the second vaporization chamber 42 makes it possible both to increase the path of the steam in the heating body 4 and to force the steam flow to return to the center of the heating body 4, in an area where its temperature is the highest.

This results in increased vaporization capacity for the same size of the heating body.

FIG. 9 illustrates a second alternative embodiment of the heating body according to the invention in which the connecting tubes 43 are not embedded in the casting of the heating body 4 but run inside the first vaporization chamber 41, near the bottom of the latter along the first electrical resistance 7 and/or the second electrical resistance 8.

Of course, the invention is in no way limited to the embodiment described and illustrated, since this embodiment was only provided by way of example. Changes can still be made without departing from the scope of protection of the invention.

Thus, in an alternative embodiment not shown, the first vaporization chamber and the second vaporization chamber can be connected by a single connecting tube.

Thus, in an alternative embodiment not shown, the iron as previously described may be connected to a steam-generating base by a cord for conveying the steam. In this alternative, the steam coming from the base and flowing through the cord is fed into the iron through the injection port provided in the lid of the heating body. The use of such a heating body in conjunction with a separate steam-generating base has the advantage of eliminating the risk of water droplets being projected from the steam outlet ports due to condensate formation in the cord.

Thus, in an alternative embodiment not shown, the first vaporization chamber may be supplied with water by means of a drip valve positioned at the level of the injection port and the housing of the iron may comprise a water reservoir supplying the drip valve by gravity.

Thus, in an alternative embodiment not shown, the closure lid may comprise several water and/or steam injection ports opening into the first vaporization chamber.

The invention claimed is:

1. A domestic appliance for ironing and/or steaming comprising at least a first vaporization chamber and a second vaporization chamber arranged in a heating body containing at least one electric resistance, and a distribution circuit configured to enable a flow of steam to be conveyed from the second vaporization chamber to at least one steam outlet hole, the first vaporization chamber and the second vaporization chamber being positioned in series and connected to each other by at least one connecting duct, wherein each of the at least one connecting duct is formed by a connecting tube inserted in the heating body, the connecting tube running in an area of the heating body heated by the at least one electrical resistance, and the connecting tube runs substantially along a longitudinal axis of the appliance.

2. The domestic appliance for ironing and/or steaming according to claim 1, wherein the connecting tube runs near said at least one electrical resistance.

3. The domestic appliance for ironing and/or steaming according to claim 1, wherein the connecting tube is made of stainless steel.

4. The domestic appliance for ironing and/or steaming according to claim 1, wherein the connecting tube extends near the center of the heating body.

5. The domestic appliance for ironing and/or steaming according to claim 1, wherein the heating body comprises an aluminum or magnesium casting.

6. The domestic appliance for ironing and/or steaming according to claim 5, wherein the connecting tube is at least partially embedded in the casting.

7. The domestic appliance for ironing and/or steaming according to claim 1, wherein the connecting tube runs on the surface of the first vaporization chamber or of the second vaporization chamber.

8. The domestic appliance for ironing and/or steaming according to claim 1, wherein the second vaporization chamber extends to the perimeter of the first vaporization chamber (41).

9. The domestic appliance for ironing and/or steaming according to claim 1, wherein the heating body comprises a peripheral wall that delimits a space in which the first vaporization chamber and the second vaporization chamber are arranged, the peripheral wall extending from the bottom wall to a lid attached to the heating body.

10. The domestic appliance for ironing and/or steaming according to claim 9, wherein the heating body comprises a partition wall that extends from the bottom wall to the lid and connects two opposite areas of the peripheral wall, the partition wall forming a separation between the first vaporization chamber and the second vaporization chamber.

11. The domestic appliance for ironing and/or steaming according to claim 10, wherein the heating body comprises an inner wall that delimits, together with the partition wall, a flow channel for the steam flow inside the first vaporization chamber, the connecting tube comprising an inlet port that opens into said flow channel.

12. The domestic appliance for ironing and/or steaming according to claim 9, wherein the lid comprises a water and/or steam injection port positioned facing an evaporation surface of the first vaporization chamber.

13. The domestic appliance for ironing and/or steaming according to claim 1, wherein the first vaporization chamber and the second vaporization chamber are connected to each other by two connecting tubes inserted in the heating body.

14. The domestic appliance for ironing and/or steaming according to claim 1, wherein the connecting tube includes a first straight portion, a bent portion, and a second straight portion.

15. The domestic appliance of ironing and/or steaming according to claim 14, wherein the bent portion is disposed between the first and the second straight portions.

16. A domestic appliance for ironing and/or steaming comprising at least a first vaporization chamber and a second vaporization chamber arranged in a heating body containing at least one electric resistance, and a distribution circuit configured to enable a flow of steam to be conveyed from the second vaporization chamber to at least one steam outlet hole, the first vaporization chamber and the second vaporization chamber being positioned in series and connected to each other by at least one connecting duct, wherein each of the at least one connecting duct is formed by a connecting tube inserted in the heating body, the connecting tube running in an area of the heating body heated by the at least one electrical resistance, and wherein the connecting tube runs on and along a surface of the first vaporization chamber or of the second vaporization chamber.

* * * * *